US005555624A

United States Patent [19]

McCracken

[11] Patent Number: 5,555,624

[45] Date of Patent: Sep. 17, 1996

[54] PACKAGE OPENER

[76] Inventor: Brian McCracken, 21416 Velicata St., Woodland Hills, Calif. 91364

[21] Appl. No.: 387,115

[22] Filed: Feb. 13, 1995

[51] Int. Cl.[6] ..... B26B 29/06

[52] U.S. Cl. ..... 30/2; 30/294; 30/DIG. 3

[58] Field of Search ..... 30/2, 289, 294, 30/290, 298.4, DIG. 3

[56] References Cited

U.S. PATENT DOCUMENTS 2,442,694 6/1948 Keiser ..... 30/289

5,085,449 2/1992 Hudson ..... 30/298.4

*Primary Examiner*—Douglas Watts

*Attorney, Agent, or Firm*—James E. Brunton

[57] ABSTRACT

A package opener that can be used safely to open packages, such a jewel boxes containing compact discs, that are encapsulated within thin outer coverings. The device includes an edge guide channel into which a cutting edge extends so that the device can be guided along a selected edge of the package to precisely cut the covering to permit its easy removal from the package.

15 Claims, 2 Drawing Sheets

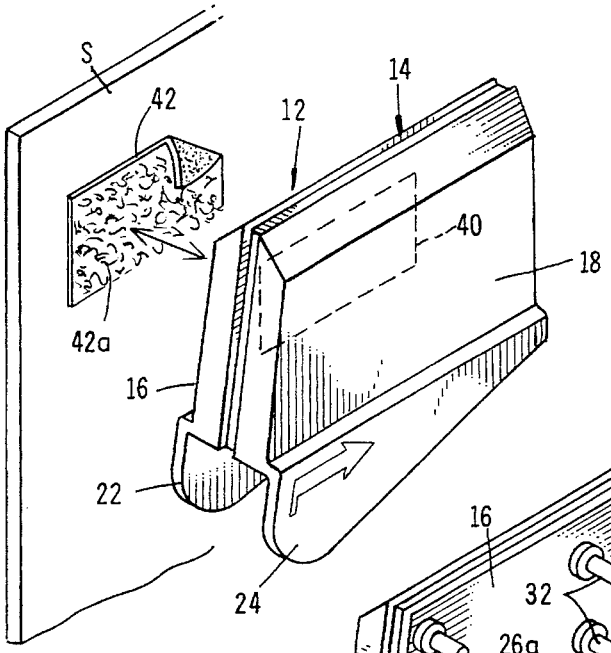
FIG. 1
FIG. 2
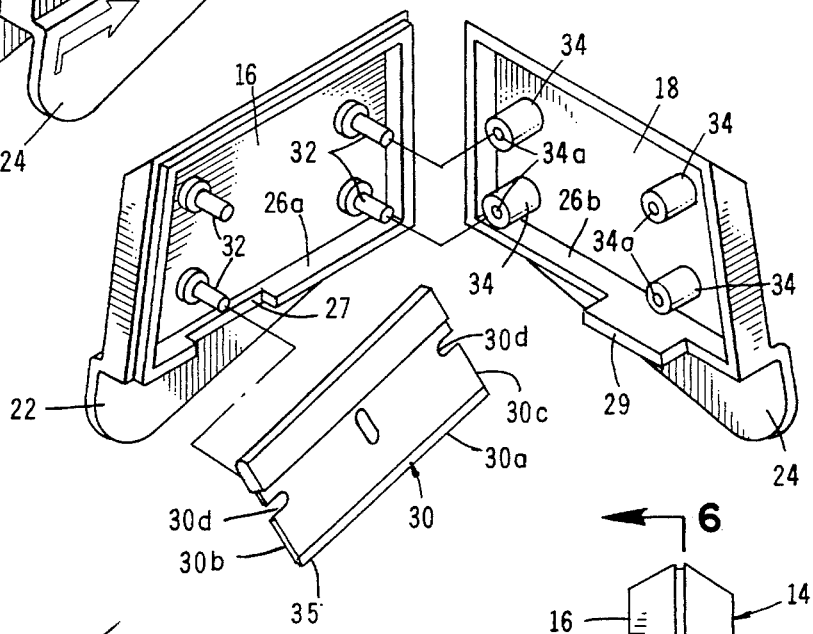
FIG. 3
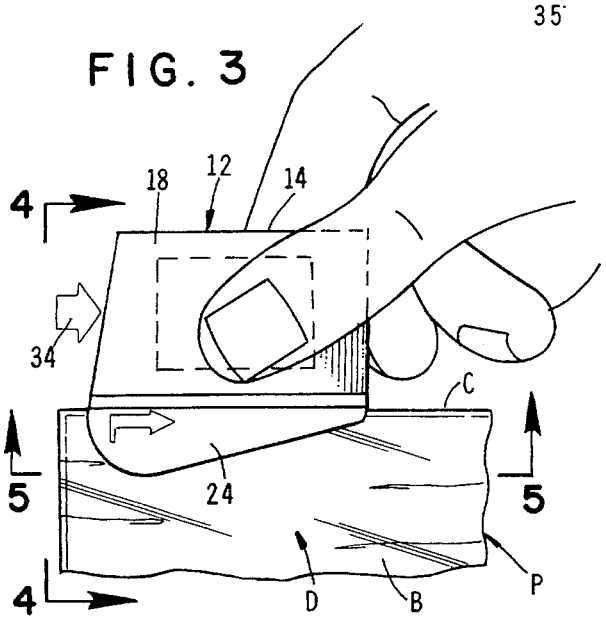
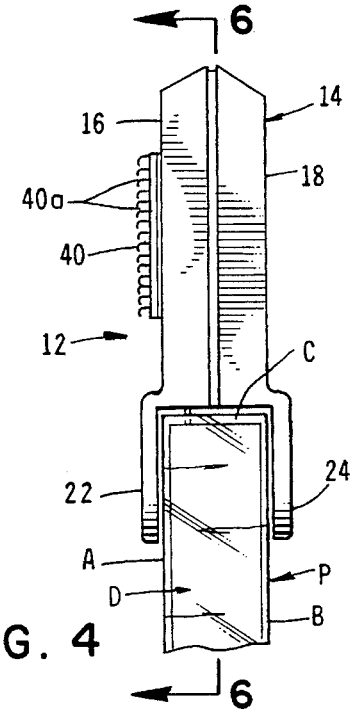
FIG. 4

PACKAGE OPENER

BACKGROUND OF THE INVENTION

1. Field of the Invention

The present invention relates generally to cutting devices. More particularly, the invention concerns a cutting device which is specially constructed for use in opening packages, such as compact disc packages, that are encapsulated within a thin, cellophane-like covering.

2. Discussion of the Invention

With the advent of shrink wrapping, many packages are closely wrapped within a thin, cellophane-like transparent covering. These coverings are typically very tough and difficult to remove from the container which they cover. For this reason, many packages are provided with built-in tear strips which assist in removing the covering. When tear strips are not provided, the covering must typically be cut with a sharp instrument so that it can then be peeled away.

A particularly difficult covering to remove is the covering that encapsulates thin boxes that contain compact discs. These boxes, sometimes known as "jewel boxes" comprise a thin, hinged plastic case within which the compact disc is stored. Covering the case is a very thin, transparent covering that must be removed before the box can be opened. Because of the thinness of the box and the toughness of the covering or wrapping, removal of the covering can be difficult and most frustrating. Attempting to cut the package covering with scissors, a knife or other sharp instrument can be dangerous to the user and can also damage the jewel box.

The thrust of the present invention is to provide a novel, compact and easy to use opener for opening sealed packages, such as boxes containing compact discs. The opener includes a razor blade that is safely contained within a closed housing so that only a small portion of the cutting edge of the blade extends outwardly of the housing and into a guide channel that is used to guide travel of the device along one edge of the encapsulated box. The guide channel is strategically sized so that during the cutting step, the cutting edge of the blade penetrates only the cellophane-like covering and does not damage the jewel box. Because the cutting edge of the blade is safely disposed within the guide channel, accidental cutting of the user's extremities is positively prevented.

SUMMARY OF THE INVENTION

It is an object of the present invention to provide a package opener that can be used safely to open packages that are encapsulated within thin outer coverings.

It is another object of the invention to provide a device of the aforementioned character which includes an edge guide channel into which a cutting edge extends so that the device can be guided along a selected edge of the package to precisely cut the covering to permit its easy removal from the package.

Another object of the invention is to provide a package opener of the construction described in the preceding paragraph in which the cutting edge is safely recessed within the guide channel so as to positively protect the user against injury.

Another object of the invention is to provide an opener of the type described that is specially adapted for use in opening packages containing compact discs.

Another object of the invention is to provide a package opener that includes a fastener arrangement that permits the opener to be conveniently, removably affixed to a flat surface.

Still another object of the invention is to provide a package opener of the class described which is compact, lightweight, easy to use and one that can be manufactured at very low cot.

BRIEF DESCRIPTION OF THE DRAWINGS

FIG. 1 is a generally perspective view of the package opener after it has been disconnected from a storage support.

FIG. 2 is a generally perspective, exploded view of the package opener shown in FIG. 1 illustrating internal construction.

FIG. 3 is a side-elevational, diagrammatic view illustrating the manner in which the package opener is used to open a package such as a compact disc holder.

FIG. 4 is an enlarged view taken along lines 4—4 of FIG. 3.

Description of the Invention

Figure 5:
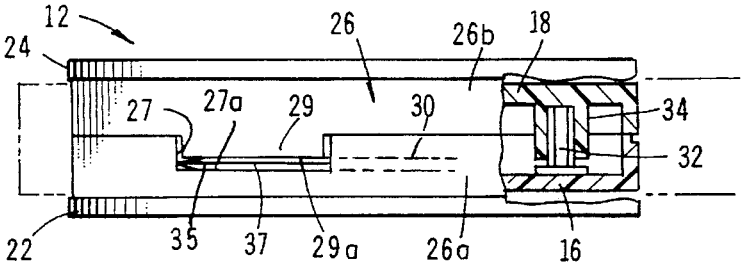
FIG. 5 is an enlarged view taken along lines 5—5 of FIG. 3.

Referring to the drawings and particularly to FIGS. 1 and 2, the package opening device of the present invention is there illustrated and generally identified by the numeral 12. The device is specially constructed for use with packages "P" of the character shown in FIGS. 4 and 8 which include spaced apart side walls A and B and a connecting wall C which interconnects side walls A and B. A thin outer covering "D" such as cellophane or a like material, extends over the side walls and the connecting wall so as to encapsulate the package "P" in the manner shown in FIG. 8.

Figure 7:
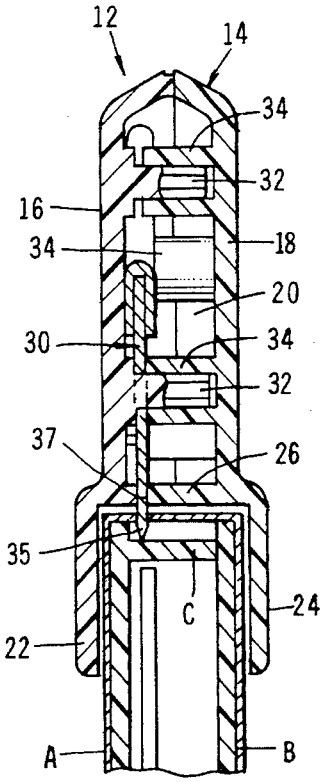
FIG. 7 is a cross-sectional view taken along lines 7—7 of FIG. 6.

Referring once again to FIGS. 1, 2 and 4, one form of the opening device of the present invention can be seen to comprise a housing 14 that includes first and second side walls 16 and 18 respectively that define an interior space (FIG. 7). Each said side wall has an integrally formed extension identified in the drawings as 22 and 24. Disposed intermediate extensions 22 and 24 and closing the bottom of interior space 20 is a base wall 26 (FIG. 7). As best seen in referring to FIG. 2, base wall 26 comprises two cooperating portions **26*a* and 26*b* which are integrally formed with side walls 16 and 18. Wall 26*a* is provided with a slot 27 while portion 26*b* is provided with a tongue 29 which is adapted to be received within slot 27, when the side walls of the device are interconnected in the manner shown in FIGS. 1 and 7 to define the transversely extending wall 26**.

Disposed within interior space 20, is cutting means for cutting outer covering "D" of the package. This cutting means is here provided in the form of a single edge razor blade 30 having an elongated cutting edge portion **30*a* and sides 30***b* and 30*c* each of which is provided with a notch 30*d*.

Figure 6:
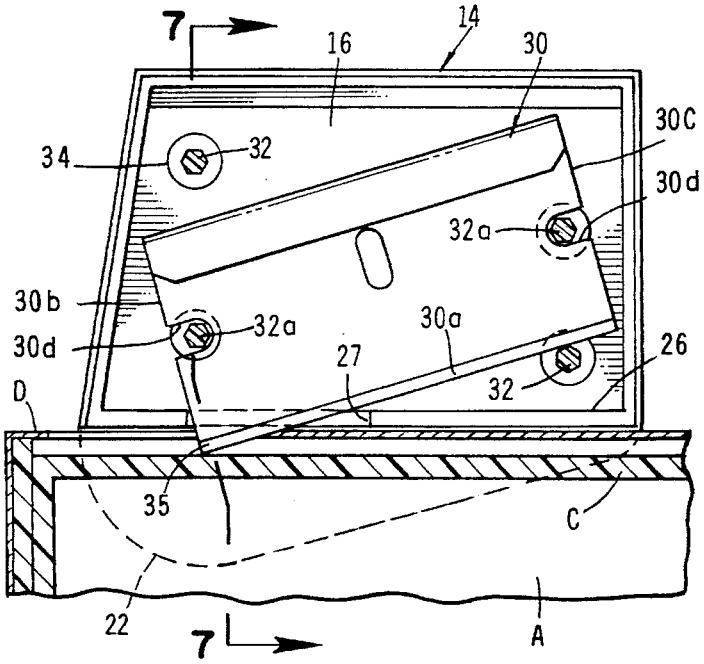
FIG. 6 is a view partly in cross section taken along lines 6—6 of FIG. 4.

Razor blade 30 is held between first and second side walls 16 and 18 by connector means which function to interconnect side walls 16 and 18 to form enclosure 20. These connector means are here provided in the form of a plurality of cooperating members comprising a plurality of posts 32 which are connected to wall 16 and extend inwardly of enclosure 20 and a plurality of inwardly extending sockets 34 which are connected to wall 18 and include openings 34*a* which are adapted to closely receive posts 32. Turning to FIG. 6, it is to be noted that posts 32 are strategically arranged so that the posts identified in FIG. 6 by the numerals 32*a* are received within slots 32*d* provided in the side edges 30*b* and 30*c* of razor blade 30 so sa to orient the blade within the interior space between 16 and 18 With this construction, the razor blade is angularly positioned within interior space 20 so that a portion of the cutting edge 30*a*, designated in FIG. 6 by the numeral 35, extends downwardly through a slot 37 formed in base wall 26 (FIG. 7). As best seen by referring to FIG. 5, slot 37 is located between the inboard edge of tongue 29 and the inboard edge 27*a* of slot 27. As best seen by referring to FIG. 7, the cutting means, or razor blade 30 is held securely in position within interior space 20 by sockets 34 which clamp the blade securely against side wall 16 when the sides of the device are interconnected in the manner shown in FIG. 7.

Figure 9:
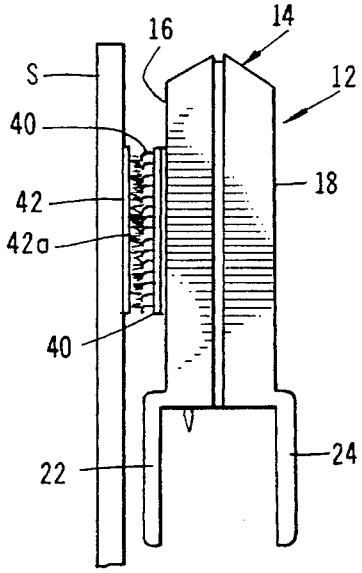
FIG. 9 is an end view of the opener showing it interconnected with the wall mounted storage support.

Turning particularly to FIGS. 1 and 9, another novel feature of the apparatus of the present invention comprises storage support means for removably connecting the package opener to a surface such as a planar surface "S". The support means here comprises a first panel 40 which is connected to wall 16 of the packaging opening device. Panel 40 is constructed of a material having a multiplicity of small hooks. The support means also comprises a second panel 42 which is constructed of a material having a multiplicity of loops 42*a* which are adapted to interconnect with hooks 40*a* when panels 40 and 42 are brought into close approximation. Panel 42 includes attachment means here provided as an adhesive backing for permitting the panel to be connected to a surface such as a wall of a disc storage container. Materials sold under the name and style VELCRO, which is a registered trademark of Velcro U.S.A., are suitable for the construction of panels 40 and 42. It is to be understood, however, that a variety of support means can be used to connect the package opener to an external support. For example, a key ring could be affixed to the package opener for interconnection with a key carrier. Similarly, a clip or small magnet could be affixed to one of the side walls of the opener for interconnection with a mating or magnet clip which is affixed to the supporting wall.

Figure 8:
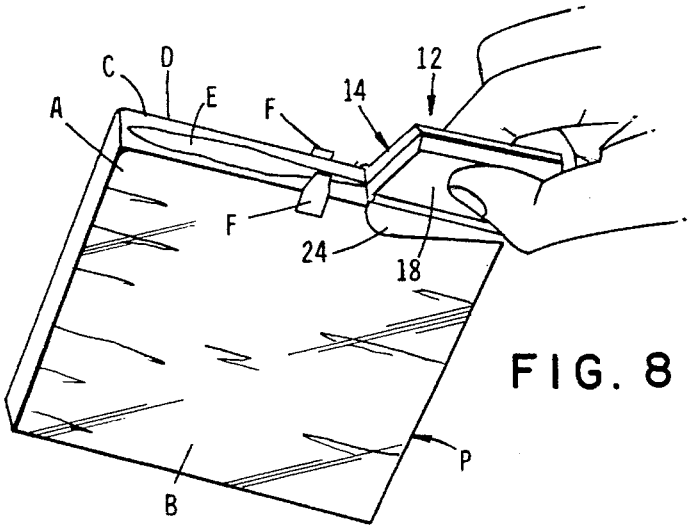
FIG. 8 is a generally perspective, diagrammatic view further illustrating the use of the package opener in opening a package sealed with cellophane.

In using the package opener of the present invention, the user grips side walls 16 and 18 with the fingers in the manner shown in FIGS. 3 and 8. The device is then positioned over a selected edge of the container to be opened in the manner shown in FIGS. 3 and 6 so that the guide channel defined between extensions 22 and 24 closely receives the side walls A and B of the sealed container. A longitudinal movement of the device in the direction of the arrow 43 of FIG. 3 will cause portion 35 of the razor blade to cleanly cut through covering "C" in the manner shown in FIG. 6. Movement of the device longitudinally of the sealed package will cause a precise cut "E" to be made in the covering "D" as the device is moved longitudinally of the connecting wall "C" of the package to be opened.

When the package to be opened comprises an encapsulated jewel box of the character used to package and store compact discs, the device is preferably run over the edge of the package having the factory seal "F" so that during the cutting operation the seal is neatly cut in the manner illustrated in FIG. 8. After the covering has been cut in the manner shown in FIG. 8, it is a simple matter to remove the covering from the package thereby enabling access to the interior of the package to remove the contents, such as the compact disc contained therewithin.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A package opening device for use in opening packages having spaced apart walls, a connecting wall interconnecting said spaced apart walls, said connecting wall having a width and a thin outer covering extending over said spaced apart walls and said connecting wall, said opening device comprising:

(a) first and second side walls defining an interior space therebetween, each said side wall having an extension, said extension being spaced apart a distance slightly greater than said width of said connecting wall;

(b) cutting means for cutting said outer covering, said cutting means including a cutting edge extending between said extensions for cutting engagement with said outer covering; and (c) connector means for interconnecting said first and second side walls and for supporting said cutting means, said connector means comprising a pair of spaced apart members connected to one of said side walls, said members engaging said cutting means in a manner to orient said cutting means within said interior space.

2. A device as defined in claim 1 further including a base wall disposed between said side walls proximate said extensions, said base wall having an opening for receiving therewithin said cutting edge.

3. A device as defined in claim 2 in which said cutting means comprises a razor blade having a body portion terminating in a cutting edge.

4. A device as defined in claim 3 further including support means connected to one of said first and second side walls for removably connecting said device to a surface.

5. A package opening device for use in opening packages having spaced apart walls, a connecting wall interconnecting said spaced apart walls, said connecting wall having a width and a thin outer covering extending over said spaced apart walls and said connecting wall, said opening device comprising:

(a) a housing having first and second side walls and a base wall disposed between said first and second side walls, said base wall having an opening therein, said side walls and said base wall cooperating to define an interior space;

(b) first and second extension walls connected to said first and second side walls respectively and extending therefrom, said extension walls cooperating to define a package receiving guide channel;

(c) cutting means for cutting said covering, including a body portion and a cutting edge, said body portion being disposed within said interior space and said cutting edge extending through said opening in said base wall and intermediate said extensions for cutting engagement with said outer covering; and (d) connector means for interconnecting said first and second side walls and for supporting said body portion of said cutting means therebetween in a manner such that said cutting edge of said cutting means extends through said opening in said base wall said connector means comprising a pair of members connected to said second side wall for engagement with said cutting means to clamp said body portion thereof against said first side wall.

6. A device as defined in claim 5 in which said cutting means comprises a razor blade having a body portion terminating in said cutting edge.

7. A device as defined in claim 6 further including support means connected to one of said first and second side walls for removably connecting said device to a surface.

8. A package opener for use in opening packages having spaced apart side walls, a connecting wall interconnecting said side walls, said connecting wall having a width and a thin outer covering extending over said side walls and said connecting wall, said package opener comprising:

(a) a housing including:

(i) a first side wall;

(ii) a first base wall portion integrally formed with said first side wall, said first base wall portion having a slot;

(iii) a second side wall;

(iv) a second base wall portion integrally formed with said second side wall, said second base wall portion having a tongue receivable within said slot; and (v) connector means connected to said side walls for connecting said side walls together to form an interior space and to position said tongue within said slot to form a base wall having an opening therein;

(b) a first extension integrally formed with said first side wall;

(c) a second extension integrally formed with said second side wall, said first and second extensions being spaced apart by a distance slightly greater than said width of said connecting wall; and (d) cutting means carried by said housing for cutting said outer covering, said cutting means including a cutting edge extending through said opening in said base wall and between said first and second extensions for cutting engagement with said outer covering.

9. A device as defined in claim 8 in which said cutting means comprises a razor blade having a body portion terminating in said cutting edge.

10. A device as defined in claim 9 in which said connector means comprises:

(a) a plurality of posts connected to said first wall and extending into said interior space; and (b) a plurality of sockets connected to said second wall and extending into said interior space, said posts being closely receivable within said sockets.

11. A device as defined in claim 10 in which said razor blade includes a pair of spaced apart slots and in which a selected pair of said posts are receivable within said slots of said razor blade.

12. A device as defined in claim 10 further including support means for removably connecting said device to a support.

13. a device as defined in claim 12 in which said support means comprises:

(a) a first panel having a multiplicity of hooks and being connected to said first wall of said housing; and (b) a second panel having a multiplicity of loops releasably interconnectable with said hooks, said second panel including attachment means for connecting said second panel to said support.

14. A device as defined in claim 5 in which said pair of members connected to said second side wall comprise sockets and in which said connector means further comprise a pair of spaced apart posts connected to said first side wall, said posts being receivable within said sockets.

15. A device as defined in claim 5 in which said razor blade engages said posts proximate said first side wall.

* * * * *